US008296907B2

(12) United States Patent
Gill et al.

(10) Patent No.: US 8,296,907 B2
(45) Date of Patent: Oct. 30, 2012

(54) LIGHT WEIGHT GRIP AND METHOD OF MAKING SAME

(75) Inventors: David Keith Gill, Pinehurst, NC (US); Billy Dee Wood, Whispering Pines, NC (US)

(73) Assignee: Eaton Corporation, Cleveland, OH (US)

( * ) Notice: Subject to any disclaimer, the term of this patent is extended or adjusted under 35 U.S.C. 154(b) by 538 days.

(21) Appl. No.: 12/454,287

(22) Filed: May 15, 2009

(65) Prior Publication Data

US 2010/0287735 A1 Nov. 18, 2010

(51) Int. Cl.
*B25G 1/10* (2006.01)

(52) U.S. Cl. ..... 16/421

(58) Field of Classification Search ..... 16/421, 16/406, 430–431, 101.1, DIG. 12, DIG. 19, 16/436; 473/300, 310; 81/489; 74/551.9
See application file for complete search history.

(56) References Cited

U.S. PATENT DOCUMENTS

| | | | | |
|---|---|---|---|---|
| 1,210,182 A | | 12/1916 | Lynch | |
| 1,831,255 A | | 11/1931 | Menzies | |
| 2,205,769 A | * | 6/1940 | Sweetland | 81/492 |
| 2,992,828 A | | 7/1961 | Stewart | |
| 3,606,327 A | | 9/1971 | Gordon | |
| 4,674,746 A | | 6/1987 | Benoit | 273/81 A |
| 4,936,586 A | | 6/1990 | Van Raemdonck | 273/73 J |
| 5,145,171 A | | 9/1992 | Head et al. | 273/67 R |
| 5,322,290 A | | 6/1994 | Minami | 273/187.5 |
| 5,330,193 A | | 7/1994 | Ijiri | 273/193 A |
| 5,362,046 A | | 11/1994 | Sims | 273/73 R |
| 5,465,967 A | | 11/1995 | Boeckenhaupt | 273/162 R |
| 5,540,625 A | | 7/1996 | Koch et al. | 473/318 |
| 5,571,050 A | * | 11/1996 | Huang | 473/300 |
| 5,713,104 A | | 2/1998 | Giampaolo, Jr. | |
| 5,735,752 A | | 4/1998 | Antonious | 473/317 |
| 5,766,088 A | | 6/1998 | Severtsen | 473/297 |
| 5,842,933 A | | 12/1998 | Lewis | 473/300 |
| 5,851,632 A | | 12/1998 | Chen et al. | 428/156 |
| 5,855,525 A | | 1/1999 | Turner | 473/300 |
| 6,354,958 B1 | | 3/2002 | Meyer | 473/297 |
| 6,421,879 B1 | * | 7/2002 | Gratz et al. | 16/422 |
| 6,434,793 B1 | * | 8/2002 | Ensson | 16/421 |
| 6,506,128 B1 | | 1/2003 | Bloom, Jr. | 473/292 |
| 6,626,768 B2 | | 9/2003 | Roelke | 473/296 |
| 6,656,054 B2 | | 12/2003 | Ulrich | 473/201 |

(Continued)

FOREIGN PATENT DOCUMENTS

CN 1332022 A 1/2002

(Continued)

OTHER PUBLICATIONS

U.S. Appl. No. 11/655,462, filed Jan. 19, 2007.

(Continued)

*Primary Examiner* — Victor Batson
*Assistant Examiner* — Matthew Sullivan
(74) *Attorney, Agent, or Firm* — Daniel S. Kalka

(57) ABSTRACT

A light weight flexible hand grip and method of making with a single piece precursor grip member having a tubular sleeve portion connected with a tubular grip portion with a wall situated therebetween. An alternate embodiment includes the tubular grip portion attached proximate an open end of the tubular sleeve portion. A core portion is disposed on an outer surface of the tubular sleeve portion and the tubular grip portion is positioned back over the tubular sleeve portion securing the core portion within an annular cavity to form the light weight hand grip.

7 Claims, 6 Drawing Sheets

U.S. PATENT DOCUMENTS

| | | | | |
|---|---|---|---|---|
| 6,656,057 | B2 | 12/2003 | Manual et al. | 473/300 |
| D502,750 | S | 3/2005 | Chen | D21/756 |
| RE38,983 | E | 2/2006 | Antonious | 473/317 |
| 7,004,655 | B2 * | 2/2006 | Ferrara | 401/6 |
| 7,008,582 | B2 | 3/2006 | Chen | 264/132 |
| 7,048,644 | B2 | 5/2006 | Wang | 473/300 |
| 7,097,797 | B2 | 8/2006 | Chen | 264/132 |
| D530,762 | S | 10/2006 | Chen | D21/756 |
| D536,048 | S | 1/2007 | Chen | D21/756 |
| 7,160,202 | B2 | 1/2007 | Chen | 473/300 |
| 7,264,759 | B2 | 9/2007 | Lamkin | 264/248 |
| 7,399,235 | B2 | 7/2008 | Gill et al. | 473/297 |
| 7,404,770 | B2 | 7/2008 | Huang | 473/300 |
| 7,458,902 | B2 | 12/2008 | Gill | 473/299 |
| 7,458,903 | B2 | 12/2008 | Wang et al. | 473/300 |
| 2002/0173371 | A1 | 11/2002 | Lamkin et al. | |
| 2003/0157990 | A1 | 8/2003 | Bloom, Jr. | |
| 2006/0068148 | A1 | 3/2006 | Ulrich | |
| 2007/0032309 | A1 | 2/2007 | Chang | |
| 2007/0074374 | A1 | 4/2007 | Chen | |
| 2007/0094826 | A1 | 5/2007 | Chandler et al. | |
| 2008/0263829 | A1 * | 10/2008 | Diasio | 16/421 |
| 2008/0313859 | A1 | 12/2008 | Chen | |
| 2009/0017935 | A1 | 1/2009 | Wang et al. | |
| 2009/0062030 | A1 * | 3/2009 | Gill | 473/288 |
| 2009/0124408 | A1 * | 5/2009 | Schroder | 473/318 |
| 2010/0212453 | A1 * | 8/2010 | Rouillard | 74/551.9 |
| 2010/0248858 | A1 | 9/2010 | Lu | |
| 2011/0143853 | A1 * | 6/2011 | Walls | 473/300 |

FOREIGN PATENT DOCUMENTS

| | | | |
|---|---|---|---|
| EP | 0227347 | B1 | 7/1987 |
| EP | 1 894 681 | | 3/2008 |
| EP | 1 923 194 | | 5/2008 |
| GB | 2 315 418 | A | 4/1998 |
| WO | WO 03-066173 | A1 | 8/2003 |
| WO | WO 2007/016617 | | 2/2007 |

OTHER PUBLICATIONS

U.S. Appl. No. 11/619,739, filed Jan. 4, 2007.
U.S. Appl. No. 11/607,707, filed Dec. 1, 2006.
U.S. Appl. No. 11/449,108, filed Jun. 8, 2006.
U.S. Appl. No. 12/406,189, filed Mar. 18, 2009.
U.S. Appl. No. 12/290,339, filed Oct. 29, 2008.
U.S. Appl. No. 12/240,315, filed Sep. 29, 2008.
U.S. Appl. No. 12/413,762, filed Mar. 30, 2009.
U.S. Appl. No. 11/936,293, filed Nov. 7, 2007.
U.S. Appl. No. 12/148,238, filed Apr. 17, 2008.
U.S. Appl. No. 12/454,287, filed May 15, 2009.
U.S. Appl. No. 11/901,349, filed Sep. 17, 2007.
U.S. Appl. No. 11/906,784, filed Oct. 3, 2007.
U.S. Appl. No. 11/619,744, filed Jan. 4, 2007.
European Search Report dated Aug. 19, 2010 for European Patent Application No. 10005082.2-1251.

* cited by examiner

LIGHT WEIGHT GRIP AND METHOD OF MAKING SAME

BACKGROUND

The present disclosure relates to flexible hand grips and particularly, grips of the type employed on a handle or shaft such as may be found on shock imparting implements like a hammer or sporting implements such as tennis racquets and golf clubs for example. Such hand grips are typically molded of pliable or flexible material such as rubber or elastomer and assembled onto the handle or portion of the implement to be grasped manually. Hand grips for such implements have the need to be frictionally retained on the handle portion of the implement and yet need to provide a soft pliable and flexible gripping surface for the user's hand, particularly where the implement is to be moved in an arcuate or swinging motion which would create exertion by the user, as is the case with golf clubs, tennis racquets and tools such as hammers or shovels. This has necessitated forming the thickness of the hand grip to an amount sufficient to provide a soft resilient or pliable surface for the user's hand not only for providing adequate grip retention but to prevent discomfort which would cause blisters upon repeated usage. However, where the material thickness has been provided sufficient to yield a compliant or pliable soft flexible surface for the user's hand, this has resulted in the need for a substantial amount of material to be provided in the grip and has yielded a grip that added weight to the implement, increased the amount of material required and a resultant increase in manufacturing costs.

Thus, it is desirable to provide a flexible pliable light weight hand grip for use on an implement which is sufficiently soft to enable the user to grip and retain a hold on the implement during forceful movement and yet provide such a grip that requires a minimum use of material and one that is relatively light in weight.

BRIEF DESCRIPTION

The present disclosure describes a light weight hand grip for assembly onto the handle or shaft of an implement such as, for example a hammer, shovel, golf club or tennis racquet and which has an inner tubular sleeve portion formed of flexible material for receiving the implement handle with a tubular grip portion formed of flexible material connected to the inner tubular sleeve portion by a wall for forming a butt end disposed approximately midway between the tubular sleeve portion and the tubular grip portion. The tubular grip portion is constructed to be turned inside out over the tubular sleeve portion with a core portion disposed on an outer surface of the tubular sleeve portion in an annular space created between the tubular sleeve portion and the tubular grip portion.

In an alternate embodiment, the tubular grip portion is flexibly connected around an open end of the tubular sleeve portion and constructed to be turned inside out over the tubular sleeve portion.

DETAILED DESCRIPTION

The present disclosure is directed to a hand grip particularly suited for use as a golf club grip. While the drawings and description make particular reference thereto, it should be readily understood that the hand grip may be used in a wide variety of other applications for shock imparting sport implements and tools. The hand grip according to the present disclosure is not limited only to golf club grips.

Figure 1:
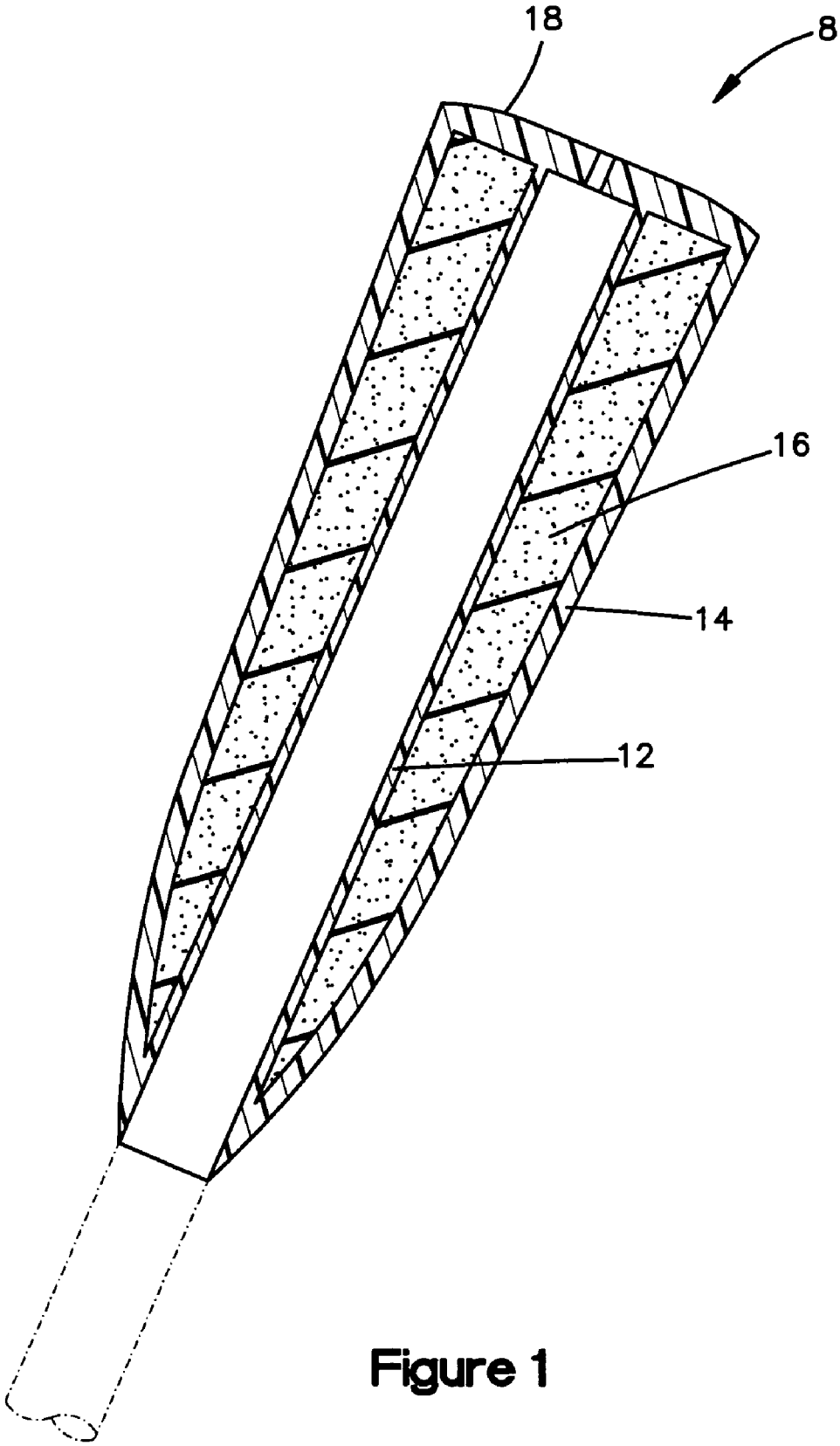
FIG. 1 is a cross-sectional view of an exemplary embodiment of the assembled hand grip.

Referring first to FIG. 1, there is shown a light weight hand grip 8 made in accordance with the present disclosure. Hand grip 8 is formed from a precursor grip member 10, as best seen in FIG. 2, having a tubular sleeve portion 12 and a tubular grip portion 14, and a core portion 16 sandwiched in between the two portions 12 and 14 as will be explained in much greater detail herein.

Figure 2:
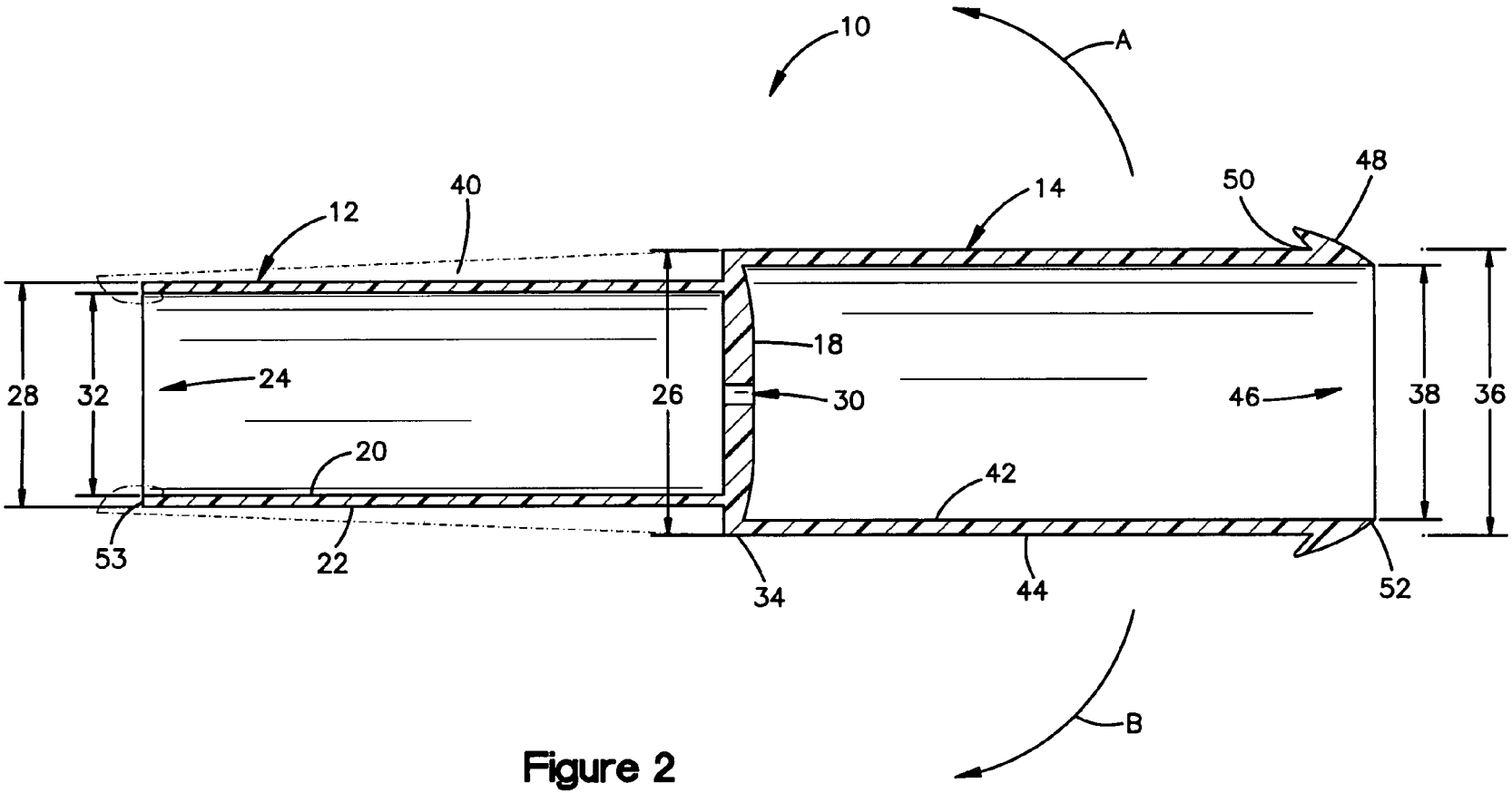
FIG. 2 is a cross-sectional view of an exemplary embodiment of the single piece precursor grip member according to the present disclosure.

Still referring to FIG. 2, the precursor grip member 10 in first embodiment is formed as one piece from a flexible material like rubber, silicone, or an elastomer. The precursor grip member 10 includes a tubular sleeve portion 12 connected to a tubular grip portion 14 by a wall 18 situated approximately midway therebetween. The wall 18 as will be described later in greater detail herein is employed to form a butt end of the grip, and later in the subject disclosure will also be referred to as the butt end. While the wall 18 is depicted in FIG. 2 as having a circular disk shaped form, it should be understood as will be seen later herein that wall can have other shapes like a fairly hemispherical shape for example. The tubular sleeve portion 12 includes inner and outer surfaces 20, 22 which define the thickness of the tubular sleeve portion 12 with an open end 24 opposite the wall 18. The open end 24 of the tubular sleeve portion 12 includes an inner diameter 32 sized to allow the tubular sleeve portion 12 to be slidably received on a shaft of an implement, for example, a golf club shaft, as seen in shadow line in FIG. 1. While the thickness of the tubular sleeve portion 12 as defined by the inner and outer surfaces 20, 22 varies with an application, for illustrative purposes only one embodiment provides a thickness ranging from approximately 0.25 millimeters (mm) to approximately 1.0 mm. In other embodiments, this thickness can range upto approximately 3.0 mm, and envisionably greater than that.

The wall 18 in this embodiment has a fairly circular shape with an outside or outer diameter 26 greater than the outside or outer diameter 28 of the tubular sleeve portion 12. Wall 18 is preferably provided with a fairly centrally located vent hole 30 used to vent solvent when attaching the finished grip to a shaft. The wall 18 can be any stylized shape, like a hexagonal or octagonal shape for example. The thickness of the wall 18 can vary with the application. In one embodiment, the wall 18 has a thickness that ranges from approximately 1.25 mm to approximately 1.6 mm.

The tubular grip portion 14 is formed of a flexible material that may be similar or dissimilar to tubular sleeve portion 12, and is flexibly connected around a periphery 34 of the wall 18. The tubular grip portion 14 has an outside or outer diameter 36 greater than the outer diameter 28 of the tubular sleeve portion 12. The inner diameter 38 of the tubular grip portion 14 is also greater than the outer diameter 28 of the tubular sleeve portion 12 and is sized in cooperation with the diameter 26 of wall 18 to provide an annular space 40 between the inner surface 42 of the tubular grip portion 14 and the outer surface 22 of the tubular sleeve portion 12 when tubular grip portion 14 is turned inside out or folded back over the outer surface 22 of the tubular sleeve portion 12 as indicated by arrows A and B. The dashed lines in FIG. 2 show the position of the tubular grip portion 14 when moved back over tubular sleeve portion 12 for forming the annular space 40. When tubular grip portion 14 is moved back or turned inside out over tubular sleeve portion 12, the wall 18 becomes the butt end 18 of the hand grip as seen in FIG. 1. The ends 52 of the tubular grip portion 14 are then attached to the ends 53 or outer surface 22 of the tubular sleeve portion 12 with a vulcanized joint or other suitable manner such as integrally bonding, adhesively attaching, fusing, or even mechanically attaching the materials together. The thickness of the tubular grip portion 14 is defined by the distance between the inner and outer surfaces 42, 44. In one embodiment, the thickness ranges from approximately 0.25 mm to approximately 1 mm. It should be immediately apparent that the dimensions for the thickness of the tubular grip portion 14, tubular sleeve portion 12, and wall 18 vary with differing applications and are not intended to be limiting of the subject disclosure. Tubular grip portion 14 includes an open end 46 opposite wall 18. Tubular grip portion 14 may optionally include a tapered flange portion 48 on its outer surface 44 proximate the open end of 46. The taper of flange portion 48 is slanted downwards towards the open end 46 pointing outwards. In alternate embodiments, the flange portion 48 may be situated on the inner surface 42 proximate the open end 46 with a similar taper as previously described. In addition, the flange portion 48 may include an undercut 50 on a side of the flange portion 48 facing the wall 18. Flange portion 48 and optional undercut 50 may be used to mechanically hold the ends 52 of the tubular grip portion 14 to the tubular sleeve portion 12 until a vulcanized joint is formed.

Figure 3:
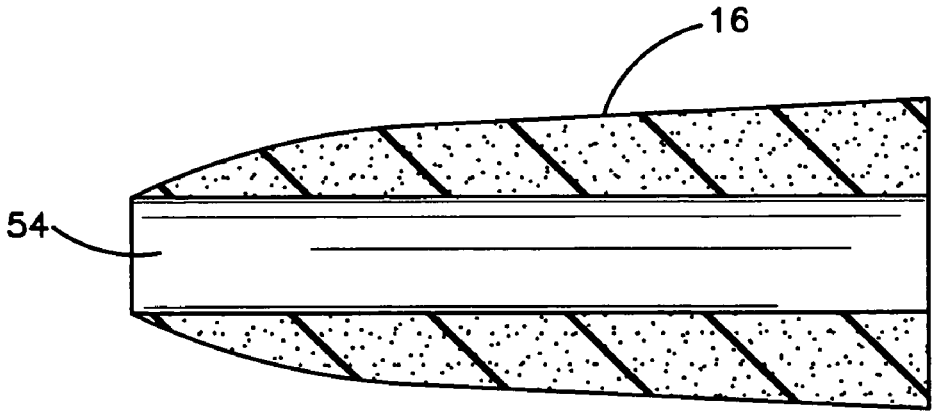
FIG. 3 is a sectional view of an exemplary embodiment of the core member.

Referring to FIG. 3, there is depicted a pre-formed core portion 16 formed of a flexible material, and in one embodiment a curable foam material with low specific gravity and high density closed cells having a slightly tapered conical shape with an aperture 54 therethrough sized to fit on the outer surface of the tubular sleeve portion and within annular space or cavity 40. In alternate embodiments of the subject disclosure, core portion 16 may be disposed on the outer surface 22 of tubular sleeve portion 12 in the desired annular space 40 by forming or molding the foam core portion 16 directly thereon. In one embodiment, core portion 16 has a specific gravity in the range of about 0.02 to about 0.05.

For illustrative purposes only, it has been found suitable to employ ethylene-propylene-diene-monomer (EPDM) material for the core portion 16, and particularly EPDM foam material. Another suitable material includes but is not limited to a blown polyethylene foam. In the present practice, it has been found satisfactory to form the curable material with a durometer in the range of about 20-50 on the Shore 'A' scale. However, it will be understood that other suitable curable light weight materials with adequate flexibility for supporting and flexibly cushioning the tubular grip portion may also be employed.

Figure 5:
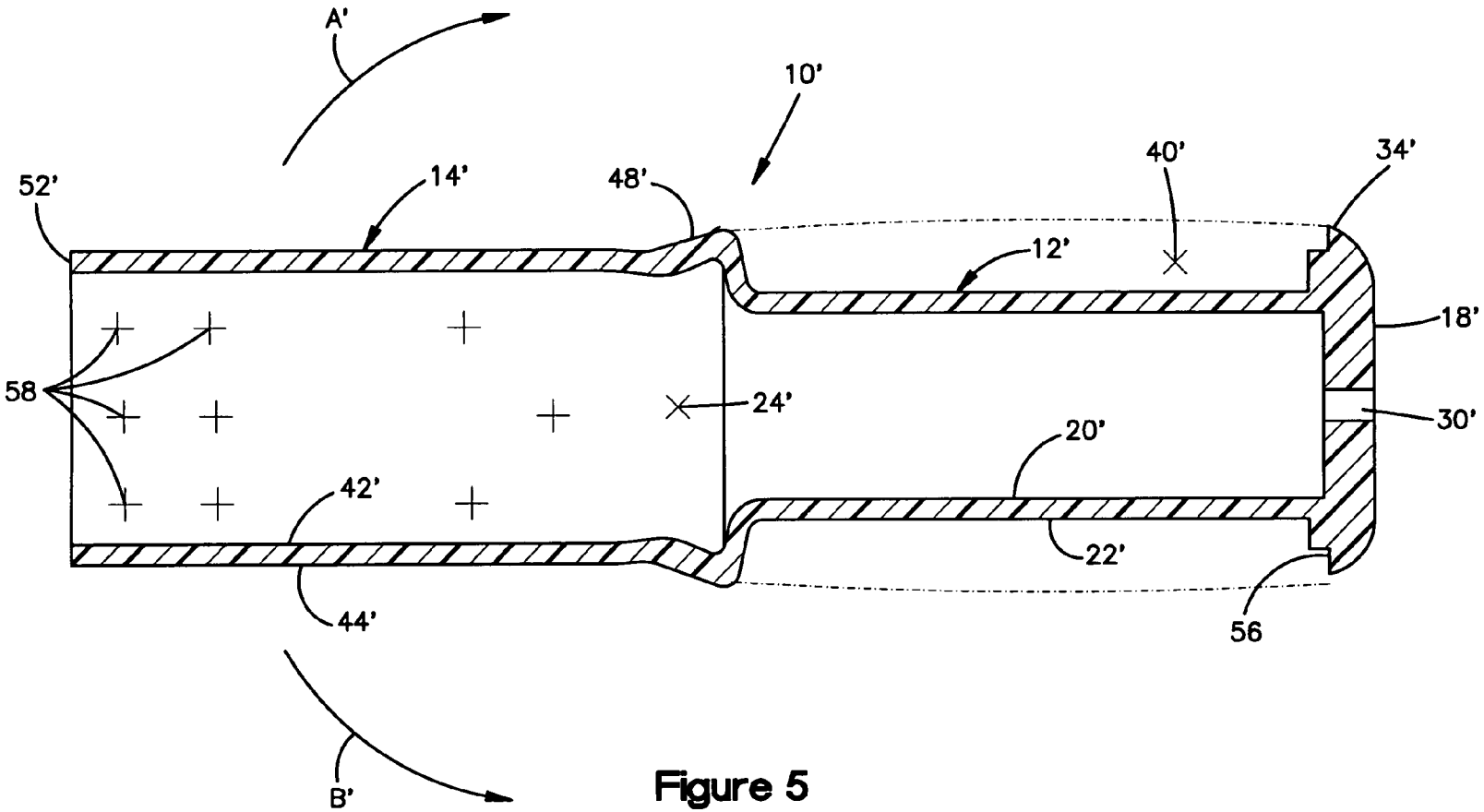
FIG. 5 is a cross-sectional view of an alternate embodiment of the single precursor grip member according to the present disclosure.

Next referring to FIG. 5, there is depicted an alternate embodiment of a precursor hand grip member 10' which is similar to the previous embodiment described except for the following details. In this embodiment, a tubular grip portion 14' is flexibly connected about the periphery of an open end 24' of a tubular sleeve portion 12' at a flange portion 48' situated on an outer surface 22' of the tubular sleeve portion 12'. Like the embodiment depicted in FIG. 2, and previously described, a core portion 16 is disposed on an outer surface 22' of tubular sleeve portion 12', and then covered when the tubular grip portion 14' is turned inside out over the core portion 16 and the tubular sleeve portion 12'. The ends 52' of the tubular grip portion 14' are then attached to a shoulder 56 at the periphery 34' of the butt end 18' to form the hand grip 18'. FIG. 5 depicts the optional design, indicia 58 that is molded into the inner surface 42' of the tubular grip portion 14' that is revealed when tubular grip portion 14' is turned inside out.

Figure 6:
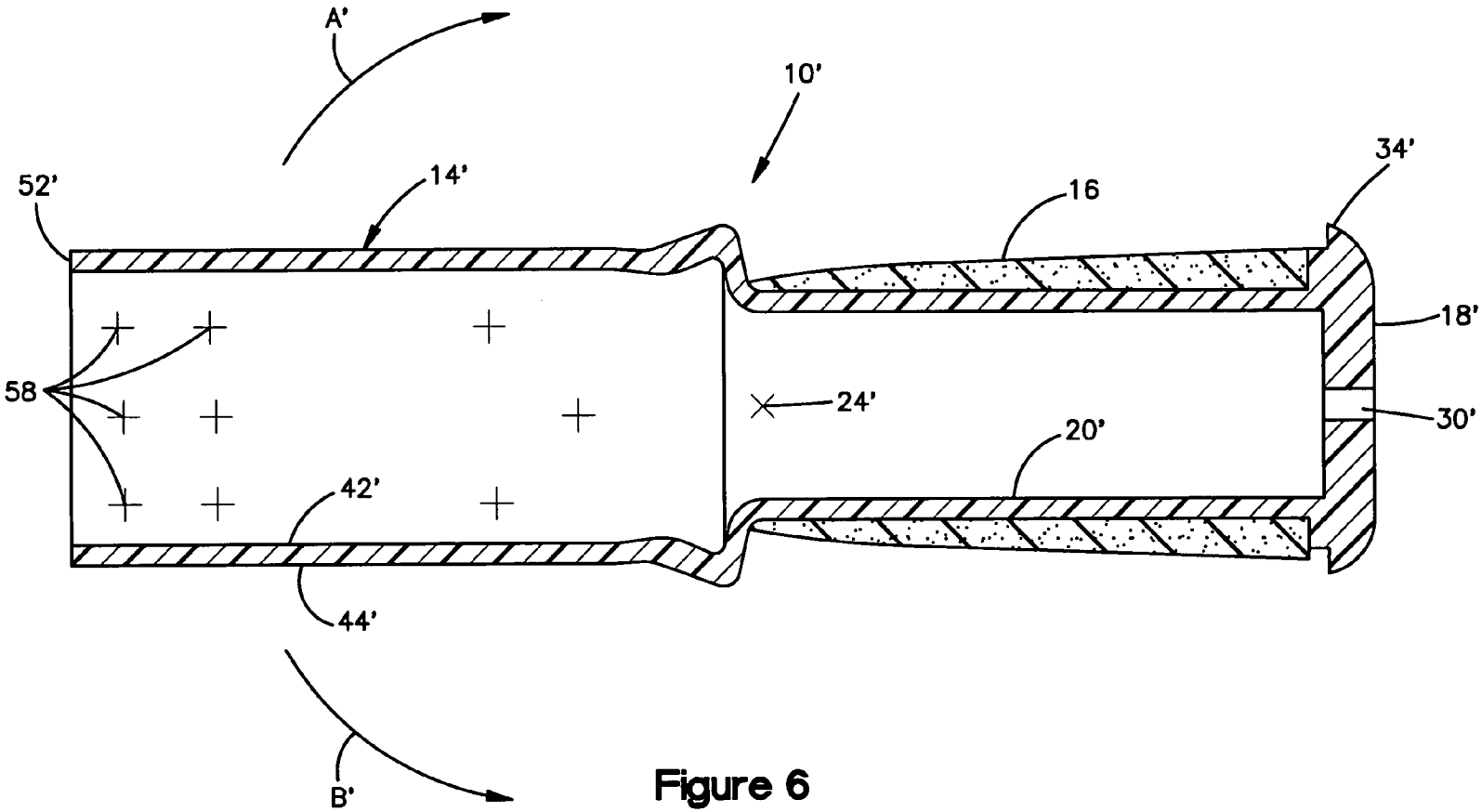
FIG. 6 is a view similar to FIG. 5 showing the foam core portion installed over the molded precursor grip member.

FIG. 6 is a view similar to FIG. 5 and shows the core portion 16 installed on the outer surface 22' of the tubular sleeve portion 12'. The core portion 16 as previously described with reference to FIG. 2 can be disposed as a pre-form as seen in FIG. 3 and slipped over the molded tubular sleeve portion 12'. Alternatively, core portion 16 can be cast or molded on the outer surface 22' of tubular sleeve portion 12'.

Figure 7:
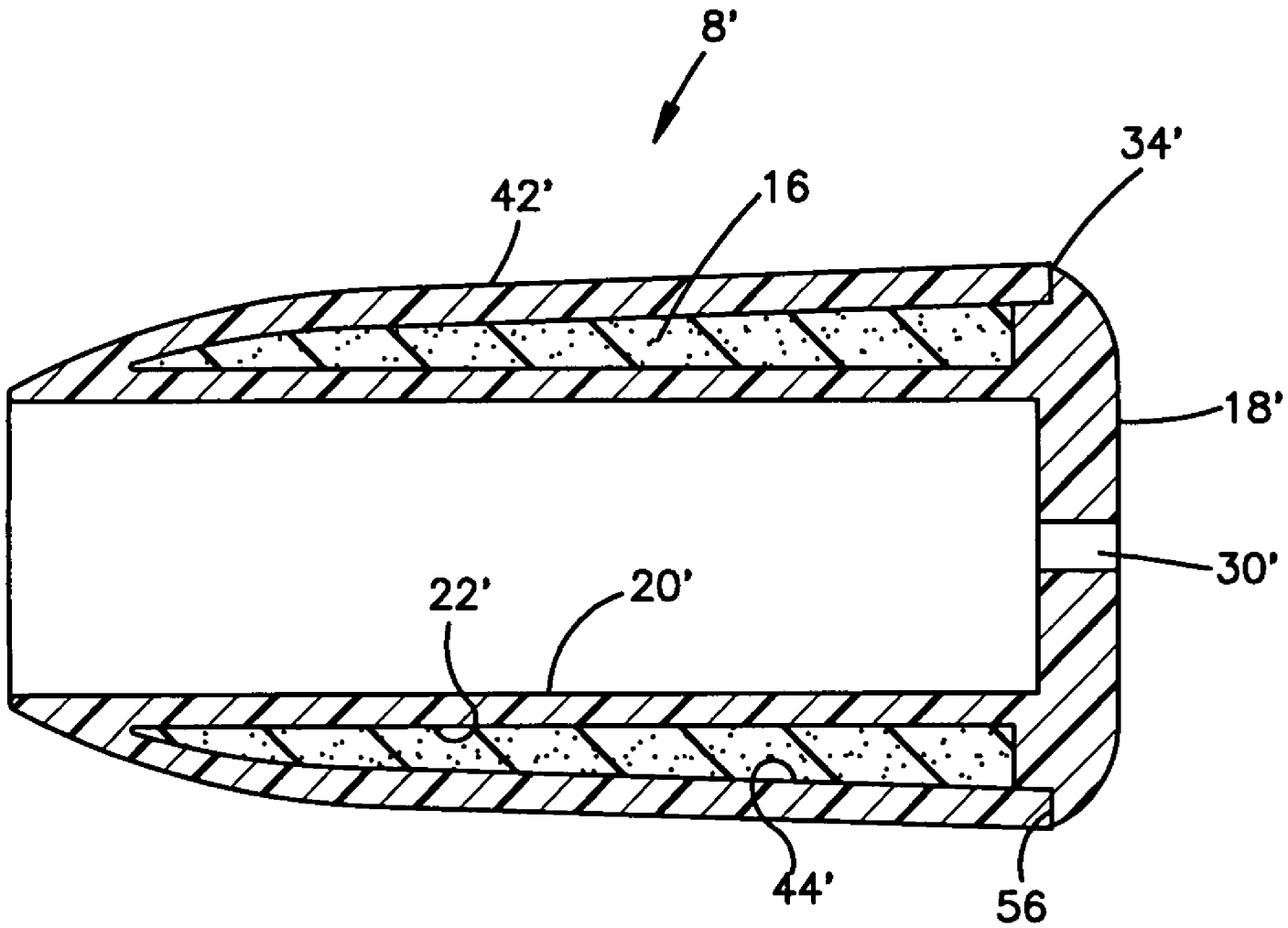
FIG. 7 is a cross-sectional view of the formed hand grip according to an alternate embodiment of the present disclosure.

FIG. 7 is a cross-sectional view of the hand grip 8' formed once the tubular grip portion 14' is turned inside out and attached at the shoulder 56 on the periphery 34' of butt end 18' with a vulcanized joint.

Figure 4:
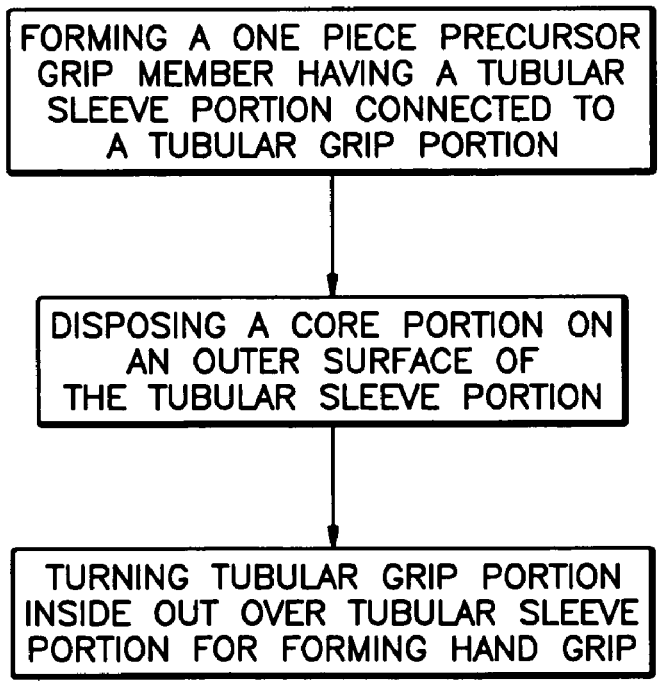
FIG. 4 is a block diagram of the method of the present disclosure.

Referring back to FIG. 4, the method of making the hand grip 18, 18' is shown in a flow diagram. The precursor grip member 18, 18' is formed as a single or piece member of a flexible material in a design and with a shape as previously described. The precursor member 18, 18' may be formed by way of a molding technique such as injection molding or compression molding. Next, the core portion 16 is disposed on an outer surface 22, 22' of the tubular sleeve portion 12, 12'. The core portion 16 may be pre-formed and simply slid on the tubular sleeve portion as a single piece or unit with aperture 54, or alternatively the pre-formed core portion 16 may be formed in sections and placed on the outer surface 22, 22' as sectional pieces, like, two hemispherical halves or four sectional pieces. Another alternative method of disposing the core portion 16 on the outer surface 22, 22' is to cast or mold the core portion 16 thereon. Still another method of disposing the core portion 16 on the outer surface 22, 22' is to form the annular cavity 40 by attaching the ends 52, 52' of the tubular grip portion, and then inject the core portion 16 as a foam into the annular cavity 40. With this method, the last two steps in FIG. 4 are reversed in order.

The grip feel for a hand grip 8 of the subject disclosure is satisfactory when the formed grip has a durometer in the range of about 35 to about 75 on the Shore 'A' scale. It will be understood that other materials may be employed as desired for providing adequate gripping by the user and the desired flexibility and "feel" when gripped sufficiently to retain control of an implement upon which the grip is affixed during rapid or forceful movement thereof.

It will be understood that although the hand grip illustrated herein is shown having the core portion relatively small compared to the outer diameter of the tubular grip portion, as would be the case for a golf club hand grip, that the proportions may be changed to accommodate larger size implements to be gripped such as would be the case for a hand grip for an implement such as a hammer, sledge hammer or shovel.

The present disclosure thus describes a flexible relatively soft light weight hand grip for an implement which is light in weight by virtue of a resilient foam core portion situated between the tubular sleeve portion and tubular grip portion.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A light weight hand grip, comprising:

a tubular grip portion formed of flexible material, said tubular grip portion having an inner and outer surface with an open end having an inner diameter;

a tubular sleeve portion formed of flexible material, said tubular sleeve portion having an open end with an inner diameter and a wall at a closed end with said wall having an outer diameter, said tubular sleeve portion being flexibly connected about a periphery of said tubular grip portion proximate said open end of said tubular grip portion, said tubular sleeve portion having an inner surface and an outer surface with an outer diameter, said outer diameter of said outer surface of said tubular sleeve portion being smaller than said inner diameter of said tubular grip portion, said tubular grip portion being constructed to move over said outer surface of said tubular sleeve portion for attachment about a periphery of said wall of said tubular sleeve portion for defining an annular space between an inner surface of said tubular grip portion and an outer surface of said tubular sleeve portion; and a core portion formed of a flexible material constructed to be disposed on an outer surface of said tubular sleeve portion within said annular space.

2. The hand grip defined in claim 1, wherein said core portion is formed of a curable foam material having a specific gravity in the range of about 0.02 to about 0.05.

3. The hand grip defined in claim 1, wherein the hand grip formed has a durometer value in the range of about 35 to about 75 on the Shore 'A' scale.

4. The hand grip defined in claim 1, wherein the core portion is formed of a curable foam material.

5. The hand grip defined in claim 4, wherein said curable foam material comprises ethylene-propylene-diene-monomer (EPDM) foam material.

6. The hand grip defined in claim 1, wherein said flexible material is a member selected from the group consisting of rubber, silicone, and an elastomer.

7. The hand grip defined in claim 1, wherein said tubular sleeve portion has a thickness ranging from approximately 0.25 mm to up to approximately 3.0 mm.

* * * * *